US011337581B2

(12) United States Patent
Heidel et al.

(10) Patent No.: US 11,337,581 B2
(45) Date of Patent: May 24, 2022

(54) HOUSEHOLD APPLIANCE HAVING AT LEAST ONE MOVABLE DOOR OR PANEL

(71) Applicant: BSH Hausgeräte GmbH, Munich (DE)

(72) Inventors: Andreas Heidel, Holzheim (DE); Sebastian Wagner, Glött (DE); Bernd Kränzle, Dischingen (DE); Peter Jochimski, Nattheim (DE); Markus Wecker, Gundremmingen (DE)

(73) Assignee: BSH Home Appliances Corporation, Munich (DE)

( * ) Notice: Subject to any disclaimer, the term of this patent is extended or adjusted under 35 U.S.C. 154(b) by 227 days.

(21) Appl. No.: 16/616,541

(22) PCT Filed: Jun. 15, 2018

(86) PCT No.: PCT/EP2018/065986
§ 371 (c)(1),
(2) Date: Nov. 25, 2019

(87) PCT Pub. No.: WO2019/011585
PCT Pub. Date: Jan. 17, 2019

(65) Prior Publication Data

US 2020/0100642 A1 Apr. 2, 2020

(30) Foreign Application Priority Data

Jul. 11, 2017 (DE) ..... 10 2017 211 855.5

(51) Int. Cl.
*A47L 15/00* (2006.01)
*A47L 15/42* (2006.01)

(52) U.S. Cl.
CPC ..... *A47L 15/4259* (2013.01); *A47L 15/0049* (2013.01); *A47L 2401/26* (2013.01);
(Continued)

(58) Field of Classification Search
CPC ..... A47L 15/4259; A47L 2501/22; A47L 15/0049; D06F 34/20; D06F 37/42;
(Continued)

(56) References Cited

U.S. PATENT DOCUMENTS 2,162,673 A * 6/1939 Johnson ..... E05B 85/22 292/33
2,208,610 A * 7/1940 Swallow ..... E05B 15/022 292/341.15

(Continued)

FOREIGN PATENT DOCUMENTS

DE 102007029901 A1 1/2009
EP 2372056 A1 10/2011

(Continued)

OTHER PUBLICATIONS

International Search Report PCT/EP2018/065986 dated Sep. 26, 2018.

*Primary Examiner* — Marc Lorenzi
(74) *Attorney, Agent, or Firm* — Michael E. Tschupp; Andre Pallapies; Brandon G. Braun

(57) ABSTRACT

A dishwasher, in particular a domestic dishwasher, includes a dishwasher cavity for receiving an item to be washed. A door or flap is configured to close the dishwasher cavity and movable between an open and a closed position. Associated to the door or flap is a two-stage or multi-stage safety catch for transition between an open and a closed state of the door or flap. A device is provided to capture whether the door or flap is closed or open and to detect a traversal of the two-stage or multi-stage safety catch.

8 Claims, 4 Drawing Sheets

(52) U.S. Cl.
CPC ..... *A47L 2401/30* (2013.01); *A47L 2501/01* (2013.01); *A47L 2501/20* (2013.01); *A47L 2501/26* (2013.01); *A47L 2501/32* (2013.01)

(58) Field of Classification Search
CPC ..... D06F 2103/40; D06F 2105/44; D06F 2224/00; E05B 2047/0068; E05B 81/66
See application file for complete search history.

(56) References Cited

U.S. PATENT DOCUMENTS

| | | | | |
|---|---|---|---|---|
| 3,133,168 | A | 5/1964 | Jacobsen | |
| 6,954,992 | B2 * | 10/2005 | Hwang | D06F 39/14 34/108 |
| 2004/0103928 | A1 * | 6/2004 | Kang | A47L 15/4259 134/57 DL |
| 2012/0138108 | A1 | 6/2012 | Astiz Montoya et al. | |
| 2013/0335222 | A1 * | 12/2013 | Comerford | E05B 65/00 340/542 |
| 2015/0097691 | A1 * | 4/2015 | Smith | A47L 15/0049 340/686.2 |
| 2016/0074912 | A1 * | 3/2016 | Kogure | B08B 3/08 134/56 R |
| 2017/0243425 | A1 * | 8/2017 | Meganck | G07C 9/00563 |

FOREIGN PATENT DOCUMENTS

| | | | |
|---|---|---|---|
| EP | 2436864 | A1 | 4/2012 |
| EP | 2599424 | A1 | 6/2013 |
| KR | 20030062538 | A | 7/2003 |

* cited by examiner

HOUSEHOLD APPLIANCE HAVING AT LEAST ONE MOVABLE DOOR OR PANEL

CROSS-REFERENCES TO RELATED APPLICATIONS

This application is the U.S. National Stage of International Application No. PCT/EP2018/065986, filed Jun. 15, 2018, which designated the United States and has been published as International Publication No. WO 2019/011585 A1 and which claims the priority of German Patent Application, Serial No. 10 2017 211 855.5, filed Jul. 11, 2017, pursuant to 35 U.S.C. 119(a)-(d).

BACKGROUND OF THE INVENTION

The present invention relates to a dishwasher, in particular a household dishwasher, includes a dishwasher cavity for receiving dishware, glasses, cutlery or similar items to be washed, wherein this dishwasher cavity is able to be closed via at least one door or flap which can be moved between an open and a closed position, and wherein a device is provided, which is used for capturing whether the door or flap is closed or open.

For the operation of a dishwasher, it is important to capture what is known as the door status (open/closed), in order to thus obtain an electronically evaluable signal, which can be evaluated by electronics or operating software.

By way of evaluable identification of this kind, it is made possible for the hydraulic circuit to be immediately interrupted on opening of the door, in order to avoid environmental damage due to leaking water. Only when the door is closed is the hydraulic circuit of the dishwasher activated, as only in this situation can the desired cleaning and drying result be achieved.

It is known to capture the door status via a Hall effect sensor, which is installed in the door, and its companion piece, a magnet in a cavity frame of the carcass. In doing so, this may result in the identification of an incorrect door status, if the tolerance setting of door sensor and companion piece is not adequate. For example, a door status "open" may then be present for the operating software, despite the door being engaged onto the lock, as far as identifiable by the user, and thus being closed. A washing program is then not started, and the user then considers their dishwasher to be faulty. Conversely, it is possible for a door status "closed" to be present for the operating software of the dishwasher, when, despite the door being forced open during operation due to an excessive pressure in the machine in spite of a movement-limiting element (lock), the sensor continues to capture a "closed" signal as a result of its faulty tolerance setting and signals said "closed" signal to the operating software.

The fundamental problem in this and comparable technical arrangements is that the real door status is defined (lock engaged or not) via the movement-limiting element (lock), but the sensor equipment, which is essential for the operating software of the dishwasher, is uncoupled therefrom.

It is furthermore known to capture an inclination of the door or flap, so as to differentiate between a vertical closed position, for example, and an open position at an angle thereto. Since, however, the water inlet has to stop very quickly when opening the door, in order to avoid damage, it is necessary for detection to take place in a reliable manner particularly when close to the vertical closed position of the door status and there must not be any incorrect information supplied even during mechanical shocks of the dishwasher (for example during activities on the worktop or coming into contact with the appliance).

BRIEF SUMMARY OF THE INVENTION

The problem underlying the invention is that of achieving an improvement here.

The invention solves the problem by means of a household appliance having a device to identify a door open or door closed condition. Further advantageous embodiments and features are also disclosed.

By way of the invention, due to the fact that, in a generic dishwasher, the door or flap is associated with a two-stage or multi-stage safety catch for the transition between open and closed state and the traversal of the two-stage or multi-stage safety catch is able to be detected by the device, it is ensured that a reliable filter for the filtering out of interfering signals with regard to the door opening or door closing is formed. Single or multiple mechanical shocks, which do not fit in the time interval, are therefore no longer detected as a signal of the door movement.

In particular, the traversal of the two-stage or multi-stage safety catch can be captured via at least one acceleration sensor, with which the change in the orientation or the angular velocity co can be captured. This drops upon reaching a respective barrier obstacle of the dual or multiple safety catch, as the door movement is braked there in order to overcome the barrier obstacle in each case.

It is possible for the acceleration sensor to capture a relative orientation with respect to the vector of the gravitational acceleration in three axes, in an advantageous and simultaneously cost-effective manner. An additional detection of the change in the angular velocity in three axes (gyroscope) is also possible.

Advantageously, the two-stage or multi-stage safety catch is associated with a lock which is able to secure the door or flap on a carcass of the dishwasher, i.e. a constructional unit which is directly responsible for obstructing the movement of the door or flap.

Particularly favorably, the traversal of the two-stage or multi-stage safety catch can be seen by way of a dual or multiple peak in an electronic evaluation. These peaks are thus able to form a characteristic pattern for the curve characteristic during the opening or closing of the door and are thus able to clearly differentiate the received signal from other signals.

It is thus possible, that only after capturing the dual or multiple peaks is a signal for changing the closed state of the door or flap emitted. This may bring about an immediate program stop and stop of the water supply into the dishwasher cavity, for example, when emitting the signal during opening.

The two-stage or multi-stage safety catch may favorably be ensured via a connecting member or a spring device bent multiple times on the lock.

Alternatively, the lock may comprise a wave profile for the sliding off of a hook part.

In any case, a two-stage or multi-stage shaping is favorable, which obstructs the free passage of an engaging part in the lock at two or more points, in order to thus obtain the desired dual or multiple signal and transmit this to the operating software.

Further advantages and features of the invention are disclosed in the exemplary embodiments of the subject matter of the invention shown in the drawing and described below.

DETAILED DESCRIPTION OF EXEMPLARY EMBODIMENTS OF THE PRESENT INVENTION

Figure 1:
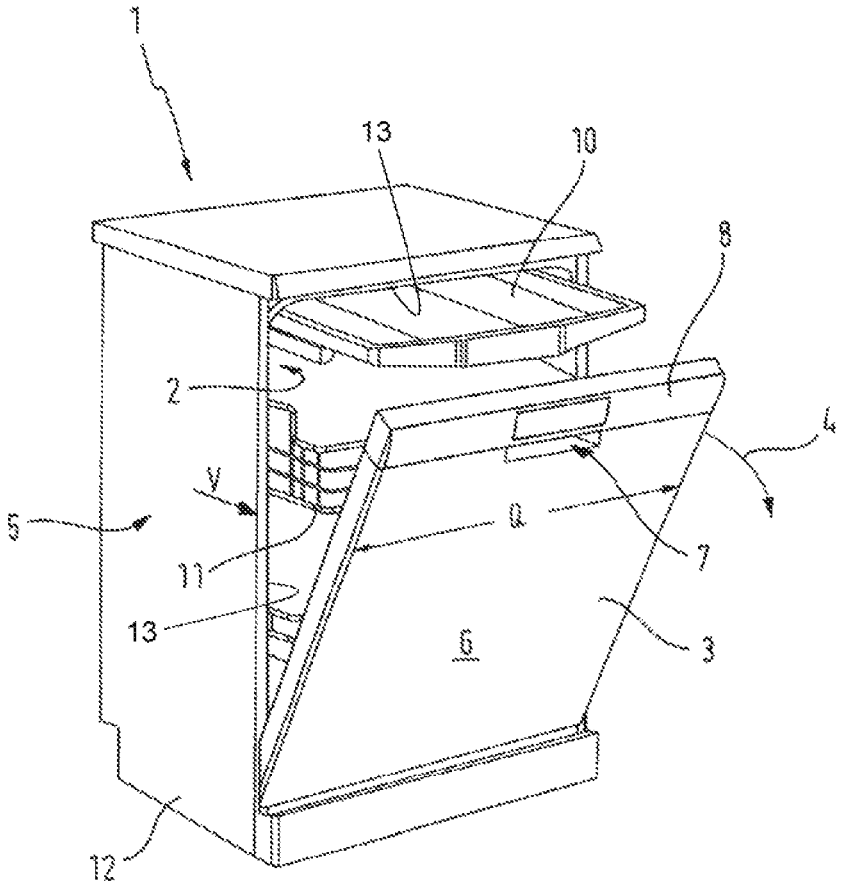
FIG. 1 shows a schematic perspective view obliquely from the front of an embodiment of a household appliance, here by way of example a dishwasher, in this case having a door on the front side.
Figure 2:
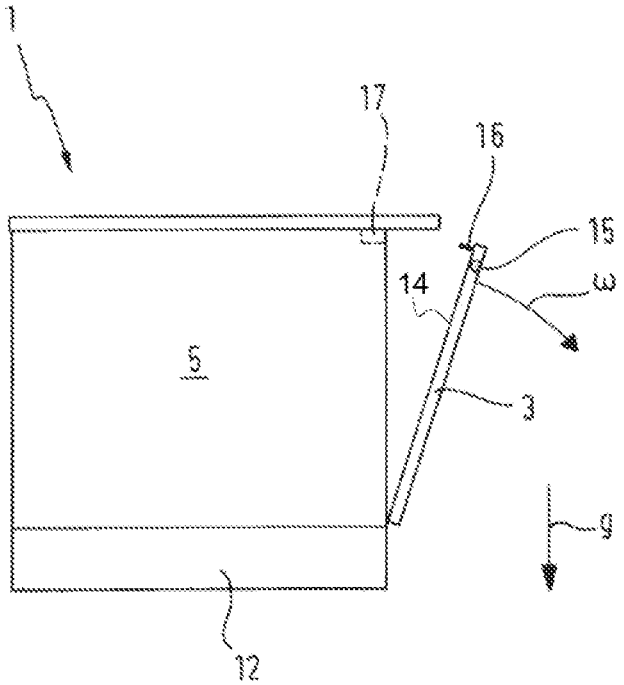
FIG. 2 shows a schematic side view of the dishwasher according to FIG. 1 with an opening door.

The dishwasher 1 schematically represented in FIG. 1 is a household dishwasher. It has, as an element of an appliance body 5 which is partially open or closed to the outside, a dishwasher cavity 2 for receiving items to be washed such as dishware, pots, cutlery, glasses, cooking utensils and the like. Here, the items to be washed can be stackable for example in baskets 11 and/or a cutlery drawer 10 and what is known as washing liquor can be able to be applied thereto. Washing liquor is understood here to mean fresh water or in particular water circulating during operation with or without detergent and/or rinse aid and/or desiccant. The dishwasher cavity 2 can have an at least substantially rectangular floor plan with a front side V facing toward a user in the operating position. Here, this front side V can form a part of a kitchen front comprising kitchen units arranged side by side, or in the case of a free-standing appliance, can also be unrelated to further units.

The dishwasher cavity 2 is able to be closed off by means of a door or flap 3, in particular on this front side V. This door 3 is shown in FIG. 1 in a partially open position, in which it is then slanted with respect to the vertical. In its closed position, on the other hand, it stands upright and is pivotable forward and downward about a lower horizontal axis in the direction of the arrow 4 at an angular velocity co according to the drawing, so that it lies at least almost horizontal in the fully opened position.

On its outer and front side V which is vertical in the closed position and faces toward the user, the door 3 can be provided with a décor panel 6 in order thus to undergo a visual and/or haptic enhancement and/or an adaptation to surrounding kitchen units.

The household appliance 1 is embodied in this case as a free-standing or what is known as a partly integrated or fully integrated appliance. In the latter case, the appliance body 5 can also close substantially with the outer walls of the dishwasher cavity 2. A housing surrounding the latter on the outside can then be dispensed with. A base 12 for receiving in particular functional elements can be disposed in the lower region of the dishwasher.

In the exemplary embodiment according to the drawing, a control panel 8 extending in the transverse direction Q of the dishwasher is associated with the movable door 3 in its upper region, which control panel 8 can comprise an engaging opening 7 accessible from the front side V for manually opening and/or closing the door 3. In the transverse direction Q, the dishwasher often has an extent of 45, 50 or 60 centimeters. Viewed rearward in the depth direction from the front side V, the extent often also amounts to approximately 60 centimeters. The values are not mandatory.

When the door or flap 3 is closed, the dishwasher cavity 2 is delimited circumferentially by three solid vertical walls 13 and two horizontal walls 13 in total, of which one forms a ceiling (above) and a further one forms a floor (below) of the dishwasher cavity 2. In this context, the wall 14 which is arranged towards the front side and the user and is able to move here forms an element of the movable door or flap 3.

In order to capture the door status, a device 15 is provided, which uses one or more sensor(s) to determine whether the door or flap 3 is closed or open or is in the phase of closing or opening movement.

This device 15 may comprise one or more sensor(s), in particular acceleration sensor(s), via which the relative orientation of the door or flap 3 can be determined. In particular, this involves inclination/acceleration sensors.

Example "identify door open":

With the door 3 closed, the acceleration sensor is situated in an idle position, the integral inclination sensor reports, for example, a 90° angle (or due to tolerances or with a slightly slanted position an angle close to said value). If the door 3 is opened by the user, then a jerk (change in acceleration), here a dual jerk, arises during the opening due to the movement-limiting element, as explained in more detail below. This dual jerk is sensed and interpreted as "door open". This door status identification is supported by a capturing of the angular position of the door 3, which has removed itself sufficiently far from the 90° (or approximately 90°) position.

Example "identify door closed":

When closing the door, the angular position of the door 3 approaches a 90° angle. This angle sensing and the jerk (dual or multiple jerk) when engaging the door 3 into the lock 17 are to be interpreted as an unambiguous signal for "door closed".

Figure 4:
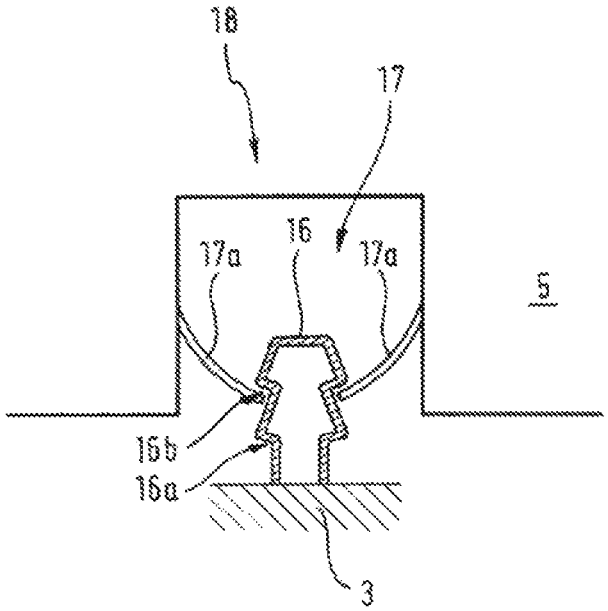
FIG. 4 shows an exemplary two-stage spring bracket as an engaging member into a lock.

As can be identified in FIG. 4, during the door movement a two-stage or multi-stage safety catch 18 is to be traversed as a movement-limiting element for the transition between open and closed state. The traversal of the dual or multiple safety catch 18 is able to be detected by the device 15. The door status is determined by a sensing of whether or not the movement-limiting element has been overcome. The companion piece for the sensor is thus the movement-limiting element itself—and not an uncoupled other technical part of the dishwasher. The specific technical embodiment may be different. By way of example, in FIG. 4 a spring bracket 16 is shown as an engaging member into a lock 17, so that, for example when opening the door 3, it first engages the lock 17 into a first dip as barrier obstacle 16*a* and subsequently engages into a second dip as barrier obstacle 16*b* of the spring bracket 16. A wave profile, a sawtooth profile or the like may also be provided in the lock 17 for the sliding off of an engaging member.

The two-part or multi-part safety catch 18—here spring bracket 16 and lock 17 with two resilient retaining fingers 17*a*—may be associated with a lock 17 which is able to fasten the door or flap 3 on a carcass 5 of the dishwasher 1.

The traversal of the two-stage or multi-stage safety catch 18 is able to be seen by a dual or multiple peak 19, 20 in an electronic evaluation, wherein after capturing the dual or multiple peak 19, 20 a signal for changing the closed state of the door or flap 3 is emitted to the operating software.

With such a solution, there is thus a dual or multiple barrier obstacle 16*a*, 16*b* in the movement when opening the door or flap 3, which can be identified and evaluated when overcoming a dual or multiple jerk.

The traversal of the two-stage or multi-stage safety catch 18 is therefore able to be captured via at least one acceleration sensor of the device 15. The acceleration sensor can capture a relative orientation with respect to the vector of the gravitational acceleration g in three axes and thus simultaneously indicate the orientation of the constructional unit provided with the sensor, here the door 3. Thus, when opening the door, initially a vertical axis is parallel to the vector of the gravitational acceleration, while at the end the door 3 lies horizontally and therefore the axis offset by 90° lies parallel to the gravitational acceleration g.

Figure 3:
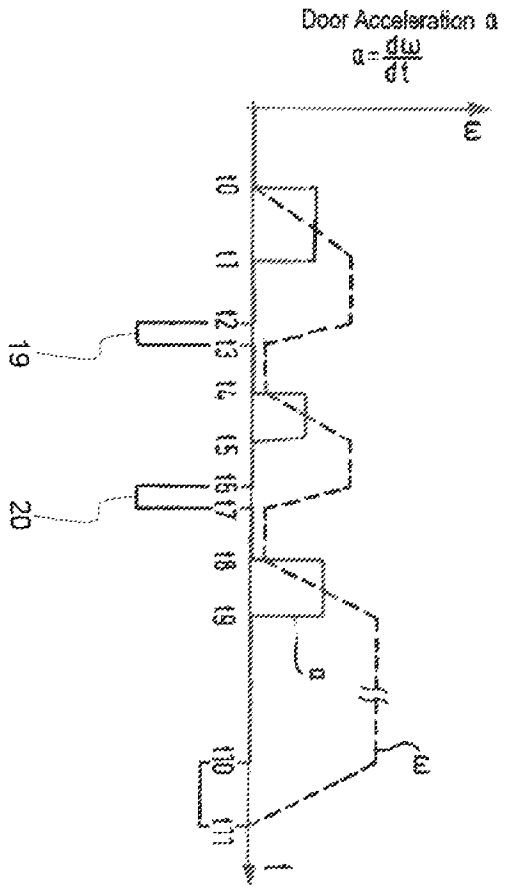
FIG. 3 shows a signal characteristic of the angular velocity and the angular acceleration of the door, plotted over time.

The curves of the angular velocity co and the derivation dω/dt, i.e. the angular acceleration a, measured by the device 15 when opening the door 3 are illustrated in FIG. 3.

This makes it clear that when pulling on the door 3 in the opening direction, on the time axis t between the markings t0 and t1, the angular velocity initially increases until it remains constant between t1 and t2. The acceleration a is zero here. When the first barrier obstacle 16*a* is reached at t2, the angular velocity initially drops, with the acceleration a becoming negative in the first peak 19. After overcoming the barrier obstacle at point t4 on the time axis, the angular velocity increases again and then becomes constantly at t5 until the second barrier obstacle 16*b* at point t6 on the time axis. At this point, the angular velocity drops again between the markings t6 and t7, with the angular acceleration a becoming negative again in the second peak 20. Accordingly appearing in the curve is the traversal of two negative regions, which map the dual jerk as a double peak 19, 20. As of t8, the second barrier obstacle 16*b* is overcome; from here on the angular velocity co is able to increase again up to the constant forward movement of the door 3 as of marking t9 on the time axis; just before reaching the complete open position at t10 by way of the user, the braking is initiated until t11.

In this context, various mechanical implementations of the dual or multiple safety catch 18 are possible. For example, the two-stage or multi-stage safety catch 18 may also be ensured via a connecting member and/or a wave profile on the lock 17 for the sliding off of a hook part.

If the door or flap 3 is opened during the program sequence, then when the signal is emitted during opening, an immediate program stop and stop of the water supply into the dishwasher cavity 2 is carried out. Conversely, when capturing the closing, the program sequence is restarted again.

The real door status, which is defined via the movement-limiting element, is no longer uncoupled from the sensing. The absolute installation position of sensor and companion piece has thus not only become less critical, but even completely irrelevant. In the invention, for example, this means that there is absolutely no danger of a cycle interruption (accidental program termination due to an incorrectly identified door opening due to excessive pressure in the dishwasher cavity during the washing cycle). This means that the process reliability of the dishwasher 1 and thus also the customer satisfaction (no incorrect error messages) increase considerably.

The invention claimed is:

1. A dishwasher, comprising:

a dishwasher cavity for receiving an item to be washed;

a door or flap configured to close the dishwasher cavity and movable between an open and a closed position;

a multi-stage safety catch associated with the door or flap for transition between an open and a closed state of the door or flap;

a device including a sensor configured to capture whether the door or flap is closed or open and to detect a traversal of the multi-stage safety catch; and wherein the multi-stage safety catch includes multiple barrier obstacles which produce movement-limiting effects in a direction of opening and closing the door or flap, such that multiple jerks arise during an opening or a closing of the door or flap due to the movement-limiting effects of the multiple barrier obstacles, wherein the sensor detects the multiple jerks, and wherein said device is configured to electronically evaluate a signal from the sensor and ascertain the traversal of the multi-stage safety catch by multiple peaks in the signal that correspond to the multiple jerks as detected by the sensor.

2. The dishwasher of claim 1, wherein the dishwasher is a household dishwasher.

3. The dishwasher of claim 1, wherein the sensor includes an acceleration sensor to capture the traversal of the multi-stage safety catch.

4. The dishwasher of claim 3, wherein the acceleration sensor is constructed to capture a relative orientation with respect to a vector of a gravitational acceleration in three axes.

5. The dishwasher of claim 1, further comprising a housing, said multi-stage safety catch including a lock which is able to fasten the door or flap on the housing.

6. The dishwasher of claim 1, wherein on condition that the door or flap is opened, an immediate program stop and stop of a water supply into the dishwasher cavity are carried out by the dishwasher.

7. The dishwasher of claim 5, wherein the multi-stage safety catch comprises the lock and a spring bracket which engages the lock, the spring bracket having formed thereon the multiple barrier obstacles.

8. The dishwasher of claim 7, wherein the multiple barrier obstacles of the spring bracket comprise a first dip as a first barrier obstacle and a second dip as a second barrier obstacle.

* * * * *